US006726184B2

(12) United States Patent
Wang

(10) Patent No.: US 6,726,184 B2
(45) Date of Patent: Apr. 27, 2004

(54) FENCE MADE OF FOAMING AGENT

(76) Inventor: Wen Ping Wang, P.O. Box 2103, Taichung (TW)

( * ) Notice: Subject to any disclaimer, the term of this patent is extended or adjusted under 35 U.S.C. 154(b) by 0 days.

(21) Appl. No.: 10/107,952

(22) Filed: Mar. 28, 2002

(65) Prior Publication Data

US 2003/0183815 A1 Oct. 2, 2003

(51) Int. Cl.[7] ..... E04H 17/22

(52) U.S. Cl. ..... 256/65.14; 256/66; 256/20; 256/19; 256/1; 47/33; D11/117

(58) Field of Search ..... 256/65.01, 65.02, 256/65.12, 65.14, 66, 19, 20, 1; 403/329; 47/33; D11/117, 133, 157; D25/38; 428/17, 24, 26

(56) References Cited

U.S. PATENT DOCUMENTS 2,799,480 A * 7/1957 Mead ..... 256/19
4,027,855 A * 6/1977 Lauzier ..... 256/21
4,787,601 A * 11/1988 Rybak ..... 256/19
4,859,510 A * 8/1989 Rademacher ..... 428/18
5,092,076 A * 3/1992 Terreta ..... 47/33
5,152,507 A * 10/1992 Lee ..... 256/13.1
5,186,119 A * 2/1993 Hlavin ..... 116/222
5,439,538 A * 8/1995 Perry ..... 156/63
5,695,174 A * 12/1997 Tsai ..... 256/22
5,945,952 A * 8/1999 Davidson ..... 343/702
6,311,428 B1 * 11/2001 Marino et al. ..... 47/46

OTHER PUBLICATIONS

U.S. Pat. Pub. No. 2003/0157275 A1 to Weghuis et al.*

* cited by examiner

*Primary Examiner*—Lynne H. Browne
*Assistant Examiner*—Jori Schiffman

(57) ABSTRACT

A fence made of foaming agent is disclosed. A bottom of the fence has at least one inserting portion, and the inserting portion is inserted to a seat. The seat is inserted to an inserting hole for being inserted by the inserting portion.

1 Claim, 6 Drawing Sheets

FENCE MADE OF FOAMING AGENT

FIELD OF THE INVENTION

The present invention relates to a fence made of foaming agent, and particularly to a fence made of foaming agent which is more safe and difficult to break.

BACKGROUND OF THE INVENTION

Referring to FIG. 8, a prior wooden fence 8 is illustrated. The fence 8 has tip bottom ends (not shown), thereby, the fence can be inserted into ground.

However, since the fence 8 is generally installed outdoors, it is possible that the fence is collided and falls down by children so as to hurt somebody. Moreover, in general, the top of the fence has tip ends and thus a great danger is formed.

Moreover, when the fence 8 falls down, the bottom 82 of the fence 8 will press soil so that the holes for being inserted by the fence becomes large. Thereby, the fence 8 becomes loose and thus is not stable. Moreover, the wooden made fence 8 is easy to break and the portions generating from a breaking fence 8 has some tip portions which is harmful to people.

Moreover, in general, the fence is made of wooden material so as to have a dull shape and color. Furthermore, the wooden fence is located outdoors, it is easy to erode due to rain or wind or because of being bitten by insects and thus the lifetime of the fence is shortened.

In general, nails and screws are necessary in installing wooden fence or iron wires are used to connect adjacent wooden strips, while it is possible that these materials are rusted in a wet environment or because of being used for a longer time. For updating these wooden stripes, it is necessary to pull it out of soil, but this operation needs to move the soil away for inserting a new one. However, this operation is not convenient.

SUMMARY OF THE INVENTION

Accordingly, the primary object of the present invention is to provide a fence made of foaming agent, wherein since the fence has a predetermined softness, the tip portion will not hurt anyone so as to increase the safety of the fence. Therefore, the safety of the fence is increased.

Another object of the present invention is to provide a fence made of foaming agent, wherein since the fence of the present invention is easily inserted into the seat. The seat is inserted on the ground. Therefore, when the fence to be updated, it is only necessary to pull the fence from the seat, and then another fence is inserted without needing to move the soil. When the fence is inserted, fences of different outlooks can be inserted into different fences.

The various objects and advantages of the present invention will be more readily understood from the following detailed description when read in conjunction with the appended drawing.

DETAILED DESCRIPTION OF THE PREFERRED EMBODIMENTS

Figure 1:
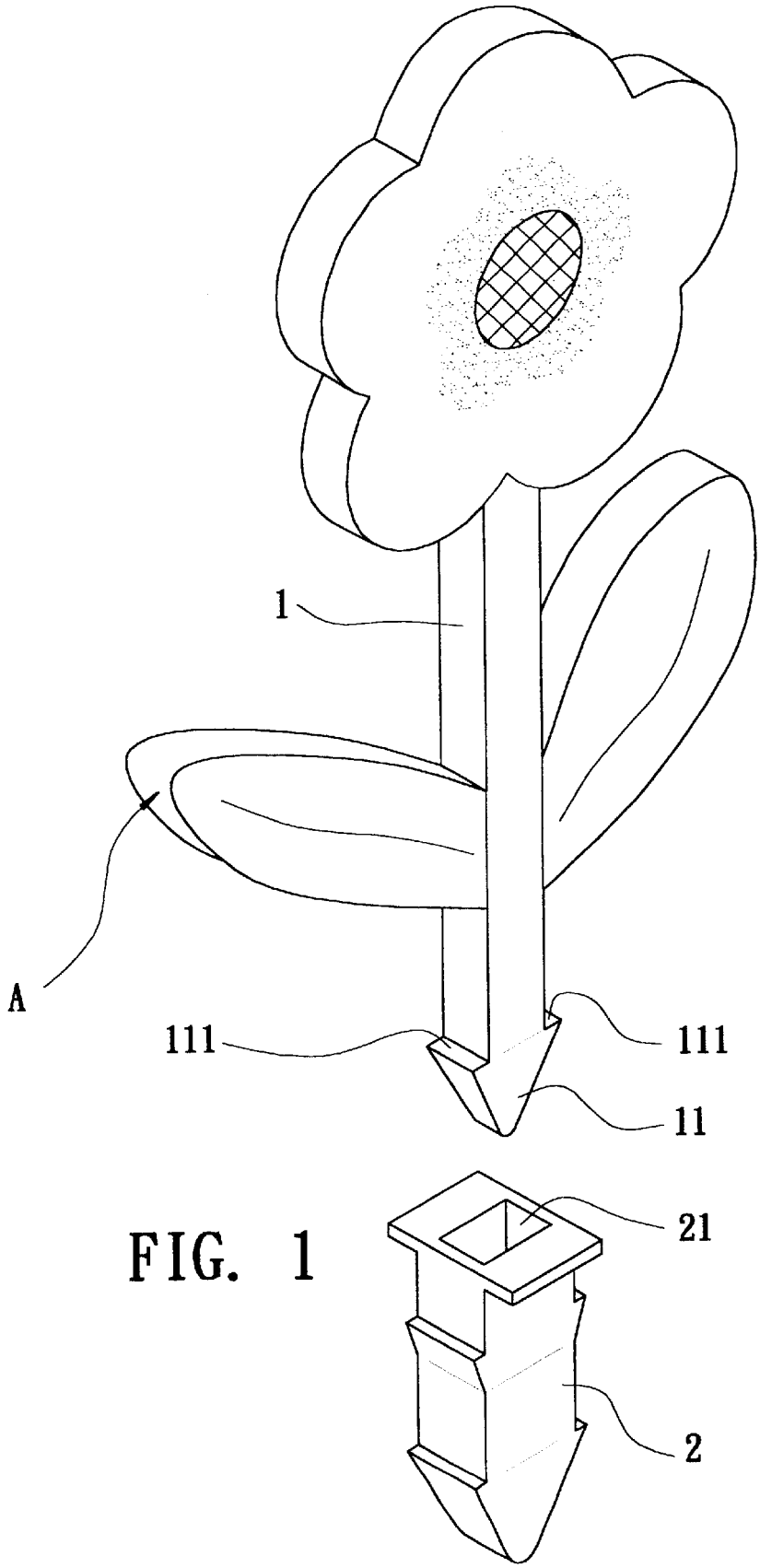
FIG. 1 is a perspective view of the present invention.

Referring to FIGS. 1 to 4, the present invention relates to a fence 1 that is made by foaming agent such as ethane acetic acid ester (EVA), polyethylene (PE), or the like. Consequently, the fence 1 is soft and elastic due to the softness characteristic of the foaming agent.

The fence 1 has an inserting portion 11 formed on a bottom thereof. The inserting portion 11 has a downward taper shape formed thereon. An interface between the inserting portion 11 and the fence 1 includes two opposite sides each having a protruded stopper 111 laterally extending from a corresponding one of the two opposite sides of the interface.

The inserting portion 11 is partially inserted into and fixedly received in a seat 2. The seat 2 has a taper shape formed on a bottom thereof and is hard for being conveniently inserted into the ground. The seat 2 has an inserting hole 21 longitudinally defined therein and upwards extending to a top of the seat 2 and corresponding to the inserting portion 11. The inserting hole 21 has a lower stopping surface 211*a* and an upper stopping surface 211 respectively formed on an inner periphery of the inserting hole 21 and the stoppers 111 of the inserting portion 11 is selectively engaged to a corresponding one of the lower stopping surface 211*a* and the upper stopping surface 211.

In using, the seat 2 is inserted into the soil. Then, the inserting portion 11 of the seat 2 is inserted into the inserting hole 21 of the seat 2. One of the two stopping surfaces of the inserting hole 21 resists at the stoppers 111 of the inserting portion 11 for making the inserting portion 11 being stable in the seat 2 and preventing the inserting portion 11 from detaching from the seat 2. The inserting portion 11 can be inserted to resist against a corresponding one of the two stopping surfaces for adjusting a height thereof relative to the ground.

Figure 3:
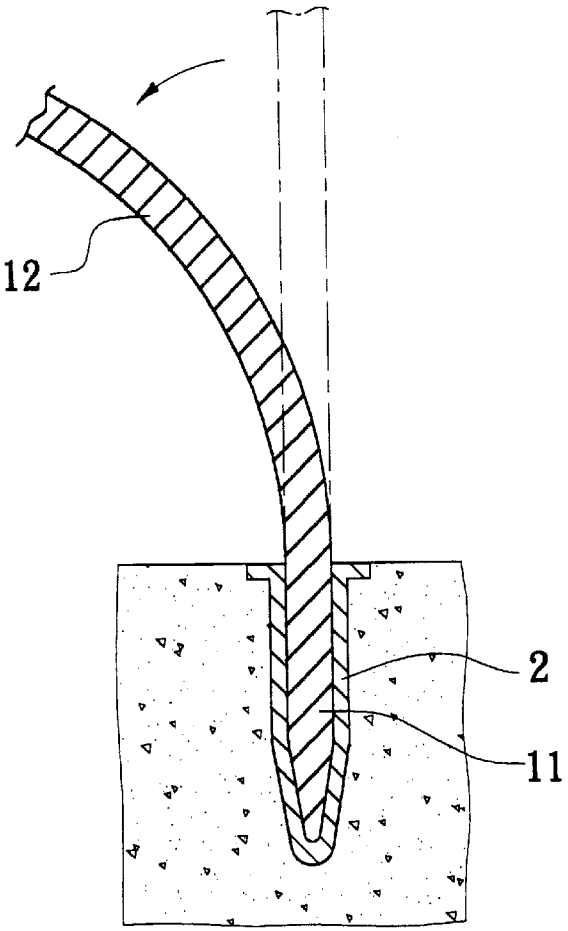
FIG. 3 is a lateral view of the present invention, wherein it is illustrated that the seat of the present invention is bendable as it is collided.
Figure 2:
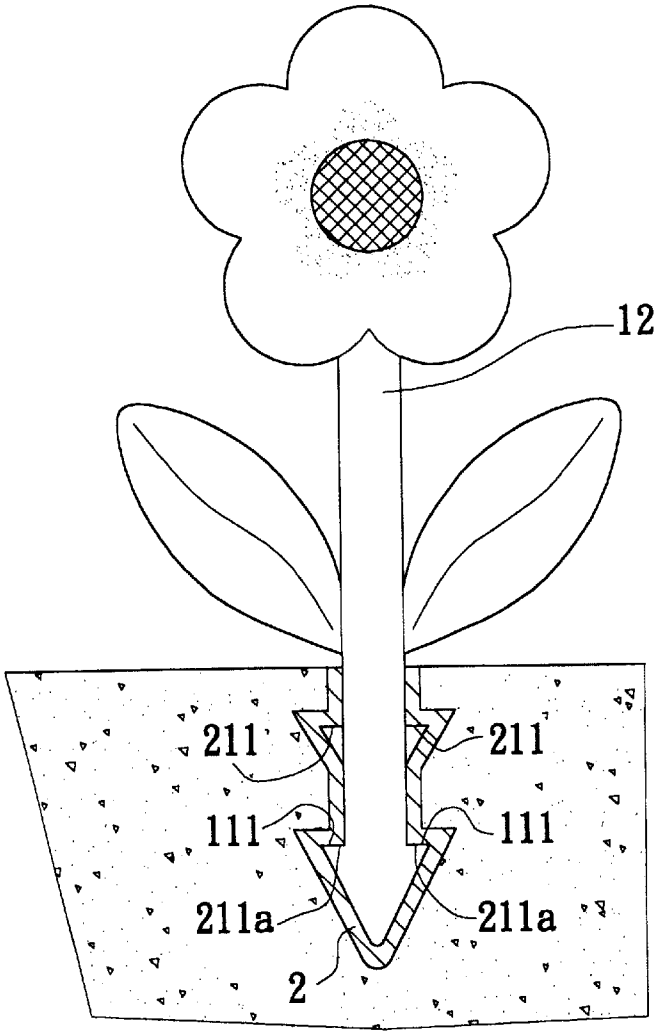
FIG. 2 is a front view of the present invention.
Figure 4:
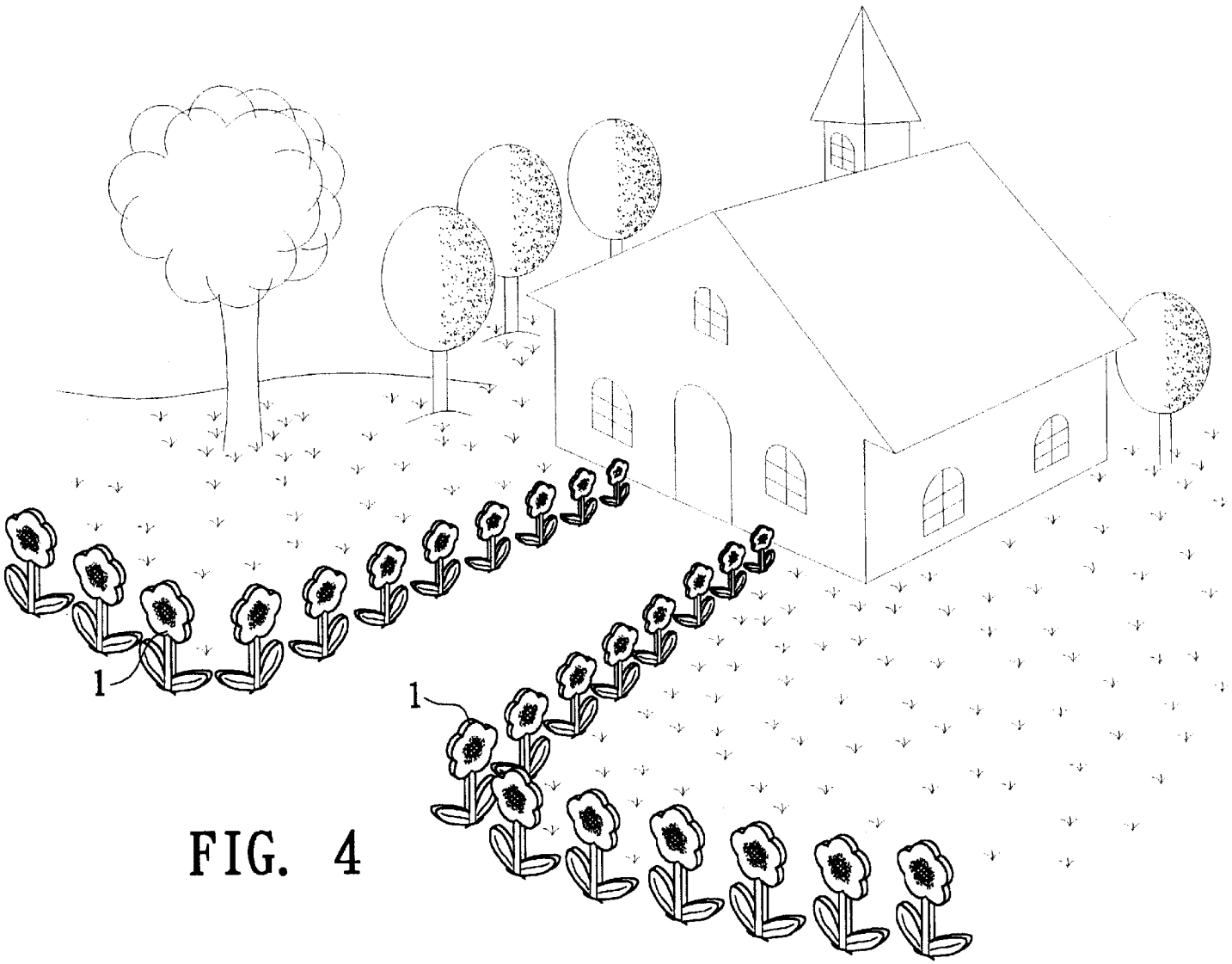
FIG. 4 shows an application that the present invention is installed in a garden.

With reference to FIG. 3, since the fence 1 is formed by foaming agent and has a predetermined softness and elastic. The fence 1 is inserted into the seat 2 by the inserting portion 11 thereof. The bottom of the fence 1 is supported by the seat 2. Therefore, when the fence 1 is collided, only the part out of the seat bends and deforms. The inserting portion 11 does not move so that the fence 1 may be inserted into soil steadily. The fence 1 will not break or erode easily so as to prolong the lifetime.

Besides, by the softness and elasticity of the foaming agent, the inserting portion 11 of the fence 1 is inserted into the seat 2. The soil at the outer side of the seat 2 will extrude the seat 2 and the inserting portion 11 so that the inserting portion 11 and the seat 2 will combine more tightly so that the inserting portion 11 can be steadily inserted into the seat 2.

Moreover, since the fence 1 of the present invention is easily inserted into the seat 2. The seat 2 is inserted on the ground. Therefore, when the fence 1 to be updated, it is only necessary to pull the fence 1 from the seat 2, and then another fence 1 is inserted without needing to move soil. When the fence 1 is inserted, fences of different outlooks can be inserted into different fences.

Moreover, as illustrated in FIG. 1, even the fence 1 has tip portion (as that illustrated in arrow A). Since the fence 1 has a predetermined softness, the tip portion will not hurt anyone so as to increase the safety of the fence 1. Furthermore, since the fence 1 is made of foaming agent. Therefore, the user may select the desired color. Then a knife mold is used to form a fence 1 having a shape like the knife mold. If it is desired to have a fence 1 of different shape, it is only necessary to mold a foaming agent by a knife mold of different shape. If it is desired that some part of the fence has different color, then that part can be printed with that color. Therefore, the shape and color of the fence may be varied as desired.

It is known from above description that in the present invention, a foaming agent is used as a material. By the softness and elasticity of the foaming agent, when the fence is collided or pressed, it may deform but not break and thus not hurt anybody so as to have a higher safety. Moreover, since the fence 1 is installed at a center of a seat. The seat has a hard structure and is inserted in the ground. As a consequence, the fence 1 can be inserted into the ground steadily. If the fence is to be updated, it is only necessary to pull the fence from the seat and then another one is inserted. Thereby, the fence can be installed conveniently.

Figure 6:
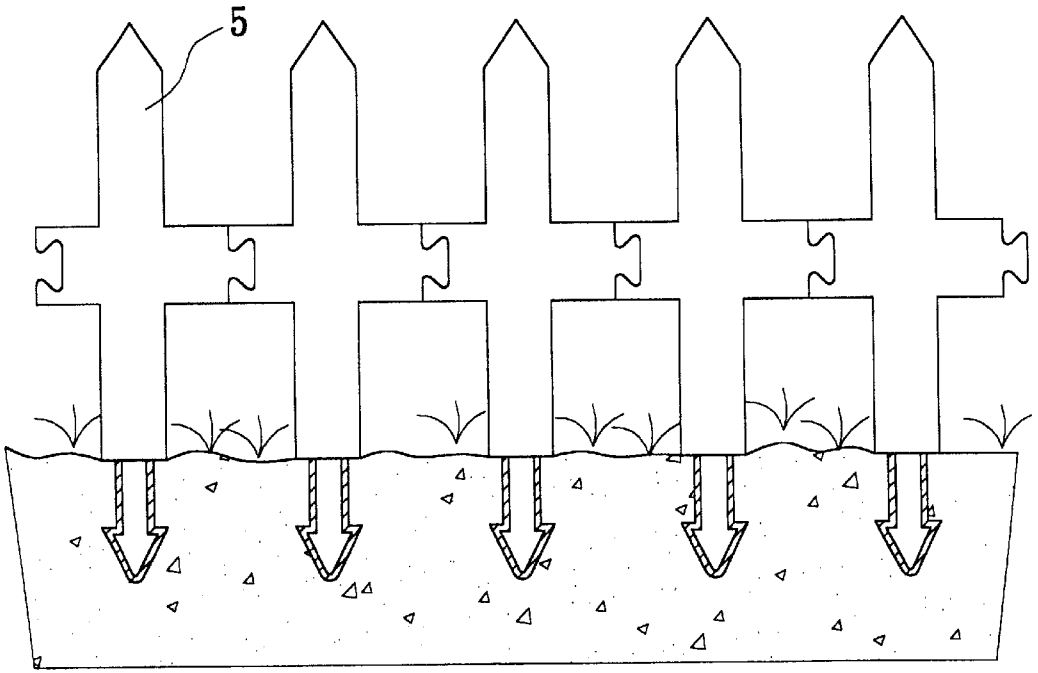
FIG. 6 is a front view of the present invention, wherein a male and a female buckling portions of each fence are buckled with the female and male buckling portion of another fence.
Figure 5:
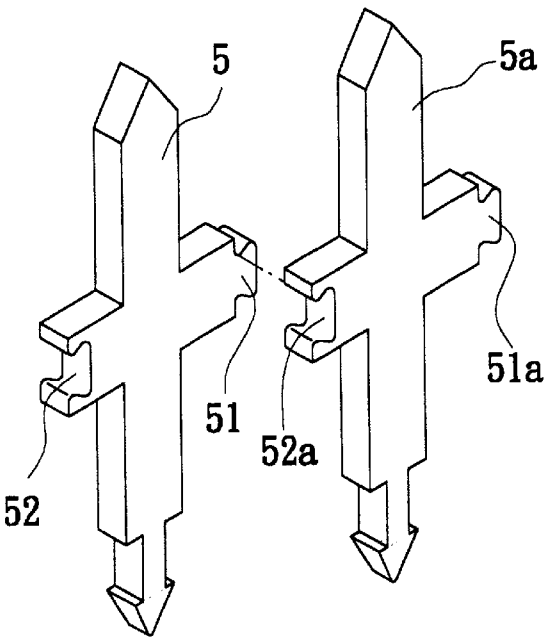
FIG. 5 is a perspective view of the second embodiment of the present invention.

Besides, many other ways can be used to embody the present invention. Referring to FIGS. 5 and 6, the second embodiment of the present invention is illustrated. The fence 1 has a cruciform and a transversal portion 53. Two ends of the transversal portion 53 have respective male buckling portion 51 and a female buckling portion 52 for being engaged with the female and male buckling portions 52*a*, 51*a*. By connecting a series fence, a continuous fence wall 50 is formed. A bottom of each fence 1 has an inserting portion 11 and each inserting portion 11 is inserted into a seat 6.

Figure 7:
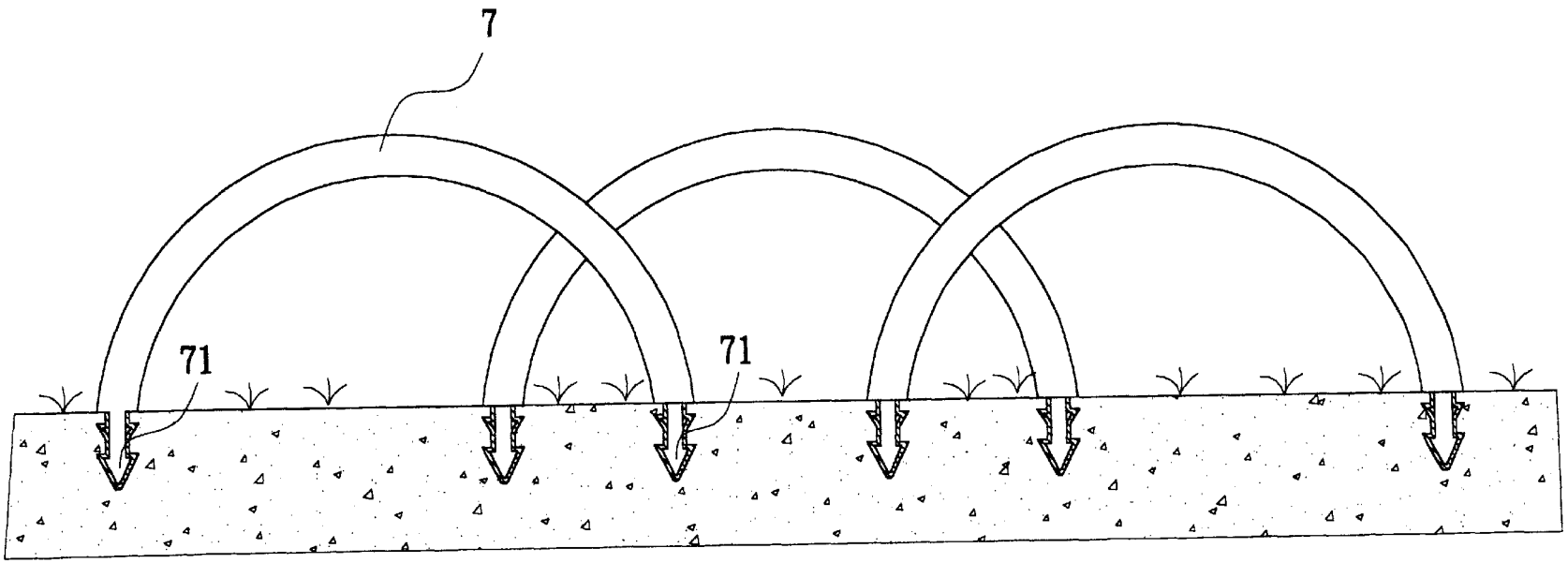
FIG. 7 shows a third embodiment of the present invention, the bottom of each fence has two inserting portions, thereby, each fence can be steadily inserted into ground.
Figure 8:
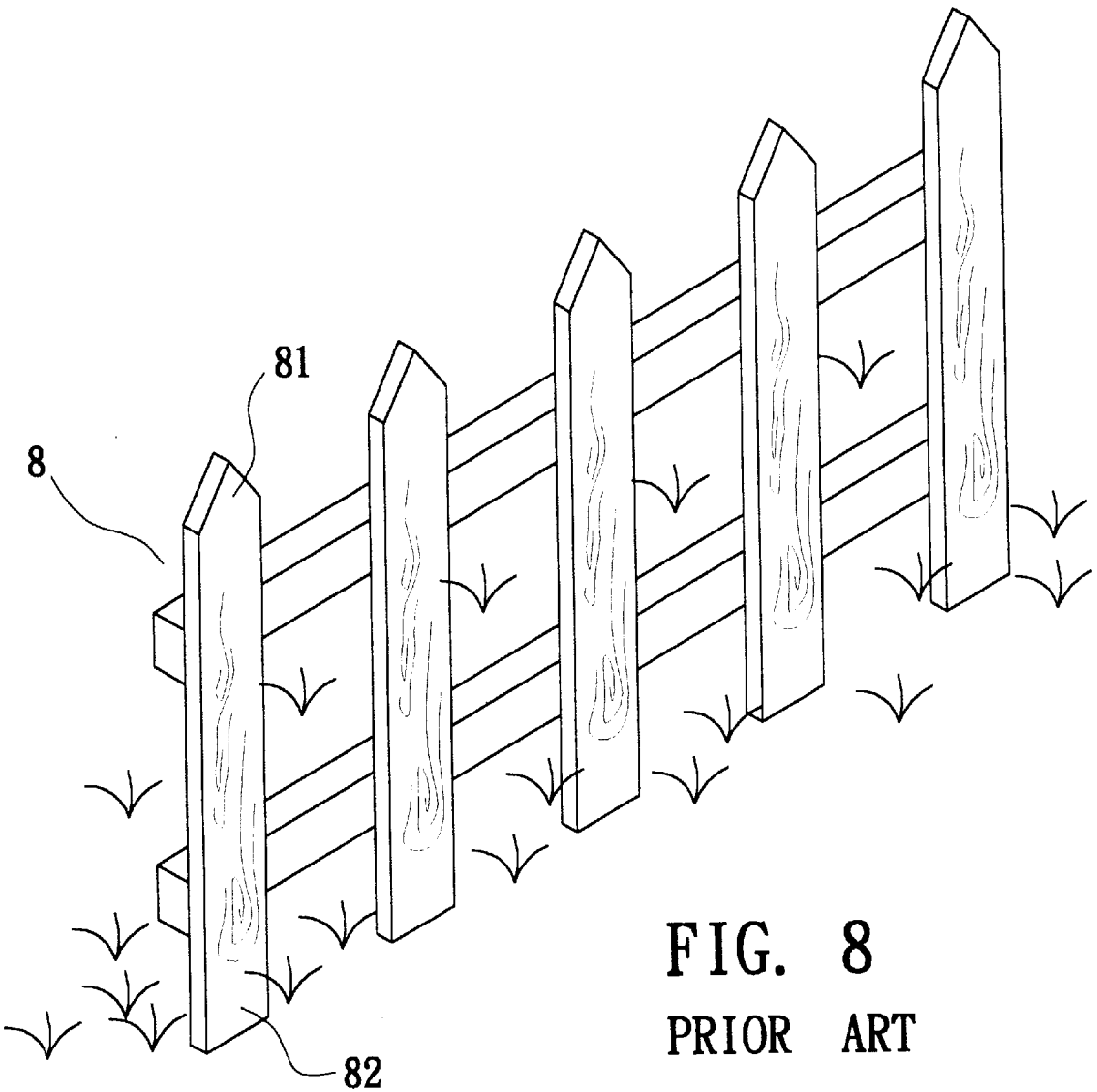
FIG. 8 PRIOR ART
FIG. 8 is a perspective view of a prior fence.

Referring to FIG. 7, another embodiment of the fence of the present invention is illustrated. The fence 7 has an arc shape so that two bottom ends are formed as two inserting portion 71. By the support of the two inserting portion 71, the fence 7 may be inserted into the ground steadily.

Moreover, from the third embodiment of the present invention, since the fence of the present invention generates foaming agent by foaming and then the foaming agent is cut by knife mold. Therefore, the shape of the fence is not confined to have a straight line, but may have a curved shape.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A fence made of foaming agent and being soft and elastic, the fence comprising an inserting portion formed on a bottom of the fence, the inserting portion having a downward taper shape formed thereon, an interface between the inserting portion and the fence including two opposite sides each having a protruded stopper laterally extending from a corresponding one of the two opposite sides of the interface, the inserting portion inserted into a seat that is adapted to be inserted into the ground, the seat having a taper shape formed on a bottom thereof and being hard for conveniently inserted into the ground, the seat including an inserting hole longitudinally defined therein and upwards extending to a top of the seat and corresponding to the inserting portion, the inserting hole including a lower stopping surface and an upper stopping surface respectively formed on an inner periphery of the inserting hole, the stoppers of the inserting portion selectively engaged to a corresponding one of the lower stopping surface and the upper stopping surface for adjusting a height of the fence relative to the ground when the inserting portion of the fence is inserted into the inserting hole in the seat.

* * * * *